US006918749B2

(12) United States Patent
Garczorz et al.

(10) Patent No.: US 6,918,749 B2
(45) Date of Patent: Jul. 19, 2005

(54) COMPRESSOR WITH ALUMINUM HOUSING AND AT LEAST ONE ALUMINUM ROTOR

(75) Inventors: Reinhard Garczorz, Loerrach (DE); Fritz-Martin Scholz, Hasel (DE)

(73) Assignee: Werner Rietschle GmbH & Co. KG, Schopfheim (DE)

( * ) Notice: Subject to any disclaimer, the term of this patent is extended or adjusted under 35 U.S.C. 154(b) by 183 days.

(21) Appl. No.: 10/343,447

(22) PCT Filed: Aug. 2, 2001

(86) PCT No.: PCT/EP01/08967

§ 371 (c)(1),
(2), (4) Date: Jan. 31, 2003

(87) PCT Pub. No.: WO02/10593

PCT Pub. Date: Feb. 7, 2002

(65) Prior Publication Data

US 2004/0022646 A1 Feb. 5, 2004

(30) Foreign Application Priority Data

Aug. 2, 2000 (DE) ..... 200 13 338

(51) Int. Cl.[7] ..... F04C 15/00; F04C 2/00

(52) U.S. Cl. ..... 417/410.4; 418/178; 418/179; 418/206.9

(58) Field of Search ..... 417/410.4; 418/178, 418/179, 206.1, 206.9

(56) References Cited

U.S. PATENT DOCUMENTS

| | | | | |
|---|---|---|---|---|
| 2,708,548 A | | 5/1955 | Blanton | |
| 3,745,854 A | | 7/1973 | Haag et al. | |
| 4,086,043 A | * | 4/1978 | Howe | 418/152 |
| 4,702,885 A | | 10/1987 | Odani | |
| 5,338,168 A | * | 8/1994 | Kondoh et al. | 418/179 |
| 6,132,532 A | * | 10/2000 | Shepelev et al. | 148/549 |

FOREIGN PATENT DOCUMENTS

| | | |
|---|---|---|
| CH | 6 65 686 A5 | 12/1984 |
| DE | 29 45 488 A1 | 5/1981 |
| DE | 31 24 247 C1 | 6/1983 |
| DE | 33 44 882 C2 | 6/1984 |
| DE | 31 49 245 C2 | 1/1986 |
| DE | 36 21 176 A1 | 7/1988 |
| DE | 37 26 209 A1 | 3/1989 |
| DE | 39 37 197 A1 | 5/1990 |
| DE | 38 10 498 A1 | 11/1990 |
| DE | 39 20 184 A1 | 6/1991 |
| DE | 38 13 272 C2 | 10/1992 |
| DE | 92 09 641 U1 | 1/1993 |
| DE | 44 12 560 A1 | 10/1994 |
| EP | 0 577 062 A1 | 1/1994 |
| EP | 1 099 855 A | 5/2001 |
| WO | WO 94/16228 | 7/1994 |

OTHER PUBLICATIONS

Patent Abstracts of Japan vol. 014, No. 247 (M–0978), May 25, 1990 & JP 02 067488 A (Kobe Steel Ltd.), Mar. 7, 1990, *English Abstract*.

Patent Abstracts of Japan vol. 017, No. 343 (M–1436), Jun. 29, 1993, & JP 05 043917 A (Mitsubishi Materials Corp), Feb. 23, 1993, *English Abstract*.

Patent Abstracts of Japan vol. 017, No. 407 (M–1454), Jul. 29, 1993 & JP 05 079468 a (Mitsubishi Materials Corp), Mar. 30, 1993 *English Abstract*.

Patent Abstracts of Japan vol. 017, No. 282 (M–1420), May 31, 1993 & JP 05 010282 A (NTN Corp; Others: 01), Jan. 19, 1993*English Abstract*.

International Search Report (Dated Nov. 22, 2001).

German Search Report (Dated Apr. 23, 2001).

* cited by examiner

*Primary Examiner*—Charles G. Freay
(74) *Attorney, Agent, or Firm*—Stuart J. Friedman

(57) ABSTRACT

The compressor has two rotors (14, 16), which are rotatably mounted in a housing (10) by means of a shaft each, the rotors (14, 16) rotating without contact with the housing. The rotors (14, 16) consist of a powder-metallurgical Al—Si alloy, and the housing (10) consists essentially of aluminum.

22 Claims, 2 Drawing Sheets

COMPRESSOR WITH ALUMINUM HOUSING AND AT LEAST ONE ALUMINUM ROTOR

BACKGROUND OF THE INVENTION

The invention relates to a compressor comprising a housing and at least one rotor rotatably mounted in the housing by means of a shaft, the rotor rotating without contact with the housing.

Compressors generally require to be cooled to dissipate the heat developing during the compression process. A direct cooling of the rotors and shafts is dispensed with in most cases for reasons of cost. Cooling of the rotors is then effected only indirectly via the flow of media conveyed and via the directly cooled housing.

Due to the housing being cooled directly, for instance by an airflow or a water cooling jacket, and the rotors being cooled only indirectly, a high temperature difference occurs in operation between the housing and the rotors. This temperature difference needs to be taken into consideration in dimensioning the gaps. The larger temperature expansion of the rotors is allowed for by enlarged gaps in the cold condition. The difference between the gap size in the cold condition and the gap size in the operating condition, i.e. with a temperature difference in the order of 100° K, is referred to as gap reduction. In order to prevent the rotors from striking against the housing at all events, the gap widths are defined to allow for the maximum thermal stress as results from the varying pressure ratios and speeds. Taking the gap reduction into account then leads to a dimensioning of the gap widths in the cold condition. Efforts are made however to keep the gaps as small as possible so as to minimize backflows and maximize both the volumetric and the isentropic efficiency.

In practice, these considerations result in the use of materials featuring low thermal expansion. The standard materials employed are lamellar graphite cast iron for the housing and nodular graphite cast iron for the rotors. The coefficient of thermal expansion is $\alpha_k=10.5^{-6}$/K in both cases. When cast iron is used for the housing and the rotors and when the rotors have an outer diameter of 100 mm, for example, a value of approximately 0.1 mm results for the gap reduction. This is sufficient to achieve satisfactory efficiencies. Use of a material such as aluminum, on the other hand, is out of the question since owing to the thermal expansion, which is more than twice as large, the corresponding values of the gap reduction would be in the range of about 0.24 mm, so that in the cold condition the gap widths would have to be more than twice as large, which would result in an enormous increase in gap leakages.

BRIEF SUMMARY OF THE INVENTION

The invention provides a compressor which in spite of the employment of aluminum materials exhibits low gap widths and a correspondingly high efficiency. In accordance with the invention the rotor consists of a powder-metallurgically produced silicon-containing aluminum material and the housing consists essentially of aluminum. By aluminum for the housing, essentially pure aluminum or an aluminum alloy is understood having the typical relative large coefficient of thermal expansion of approximately $23.8\times10^{-6}$/K. The powder-metallurgically produced silicon-containing aluminum material, on the other hand, typically has a coefficient of thermal expansion of only $16\times10^{-6}$/K. Again, proceeding from a rotor diameter of 100 mm, in the case of a difference in temperature of 100° K, in the combination of materials in accordance with the invention a gap reduction results which is calculated as follows:

$$S_{WA}=(\alpha_{k1}\times\Delta T_1-\alpha_{k2}\times\Delta T_2)\times L.$$

At a value of 0.113 mm, the gap reduction is therefore hardly larger than the corresponding value when using cast iron for the housing and the rotors.

The use of aluminum instead of cast iron brings significant advantages, in particular lower weight, shorter machining times, resistance to corrosion, lower manufacturing costs.

In the preferred embodiment, the surfaces of the rotors have an insulating layer applied thereon. This insulating layer reduces the heat transfer from the compressed conveyed medium to the rotors. Dissipation of the heat flow via the shaft of the rotor is increased. The reduced heating of the rotors as caused by the insulating layer results in a lower thermal expansion and therefore permits smaller gap widths, thus increasing the efficiency.

BRIEF DESCRIPTION OF THE DRAWINGS

Further features and advantages of the invention will be apparent from the following description of two embodiments of the compressor and from the accompanying drawings, in which.

DETAILED DESCRIPTION OF THE INVENTION

Figure 1:
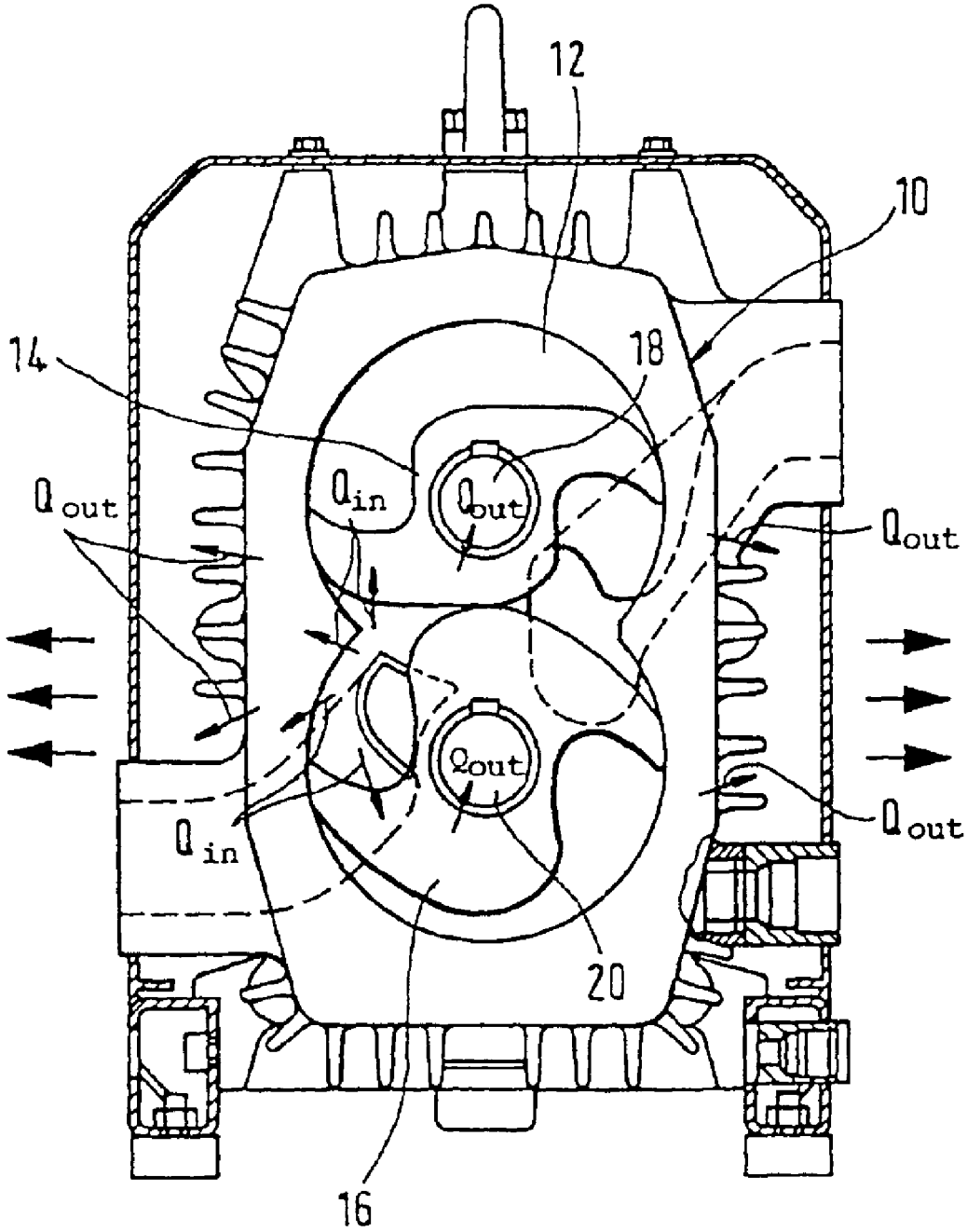
FIG. 1 schematically shows an opened claw-type compressor with a view of the rotors.

The compressor shown in FIG. 1 as an example has a housing, generally designated by 10, comprising an inner chamber 12 which consists of two overlapping partial cylinders of equal size. Accommodated within the chamber 12 are two rotors 14, 16 of the two-blade Roots type. Each rotor 14, 16 is seated on a respective shaft 18, 20. The shafts 18, 20 are parallel to each other and synchronized by a gearing (not shown). The rotors 14, 16 run in the interior of the chamber 12 without mutual contact and without contact with the wall of the chamber 12. They roll off into each other, forming working spaces of variable sizes in the process, with an internal compression occurring.

The heat arising during operation of the compressor is dissipated substantially by cooling of the housing 10. For this purpose, the housing 10 includes a multitude of cooling fins that are exposed to an airflow. The heated exhaust air is symbolized by arrows in the drawing. The rotors 14, 16 and the shafts 18, 20 are not cooled directly. A part of the heat flow is dissipated via the shafts 18, 20 and another part via the flow of media conveyed. In order to reduce the heating of the rotors 14, 16 in operation, the surfaces thereof are provided with a thermally insulating coating.

The housing 10 consists of aluminum or an aluminum alloy whose coefficient of thermal expansion amounts to approximately $23.8\times10^{-6}$/K. The rotors 14, 16 consist of an aluminum material whose coefficient of thermal expansion amounts to approximately $16\times10^{-6}$/K. This mating of materials results in a gap reduction which amounts to approximately 0.113 mm, as related to a rotor diameter of 100 mm.

The aluminum material of which the rotors 14, 16 are made is produced by powder metallurgy and is dispersion-strengthened. The composition of the aluminum material for the rotors is preferably as follows:

18.5 to 21.5 wt.-% silicon, 4.6 to 5.4 wt.-% iron, 1.8 to 2.2 wt.-% nickel, balance: aluminum The principle on which the invention is based can be applied with most types of compressors having non-contacting rotors, but is applicable to special advantage in twin-shaft compressors with internal compression, such as claw-type compressors and screw-type compressors. The invention generally encompasses the use of a powder-metallurgical Al—Si alloy in rotors of compressors, pumps and rotating piston machines in combination with a housing made of aluminum, in particular in machines comprising rotors that operate free of contact.

Figure 2:
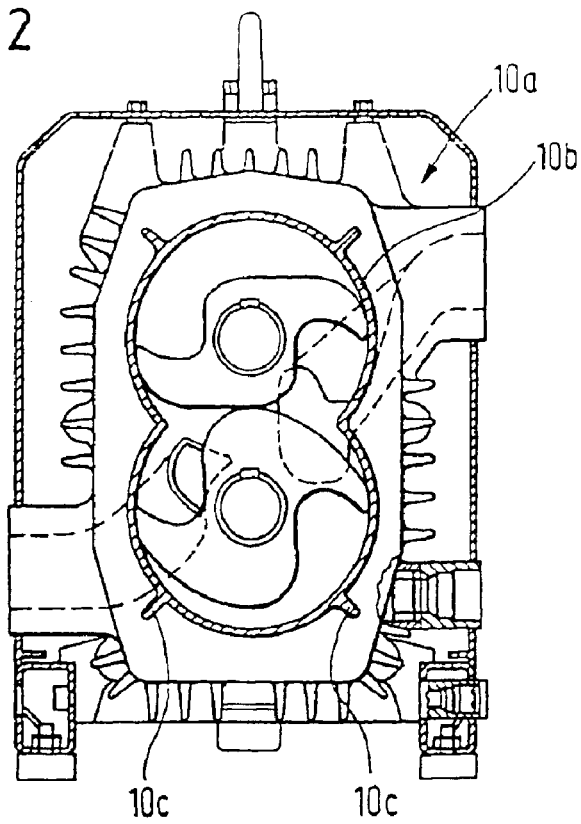
FIG. 2 shows a corresponding view of a variant.

In the variant shown in FIG. 2 the housing is constructed of an external body 10*a*, which is made of aluminum or an aluminum alloy, and a ring 10*b* cast therein. The ring 10*b* consists of a powder-metallurgical, dispersion-strengthened Al—Si alloy of the kind described in more detail above. The ring constitutes the boundary of the chamber in which the rotors of the compressor are accommodated. At the interface between the external body 10*a* and the ring 10*b* the two materials are fused together so that there exists an intimate interconnection between the external body 10*a* and the ring 10*b*. Since the ring 10*b* consists of a material having a substantially greater strength than the material of the external body 10*a*, its thermal expansion properties substantially dictate the thermal expansion of the housing as a whole. In this embodiment, the rotors also consist of an Al—Si alloy of the type described above. The ring is provided with integrally cast stiffening ribs 10*c*, which are directed radially outwards. One such stiffening rib is arranged in each corner area of the housing.

With this embodiment a gap reduction of about 0.16 mm can be achieved, again as related to a rotor diameter of 100 mm.

Figure 3:
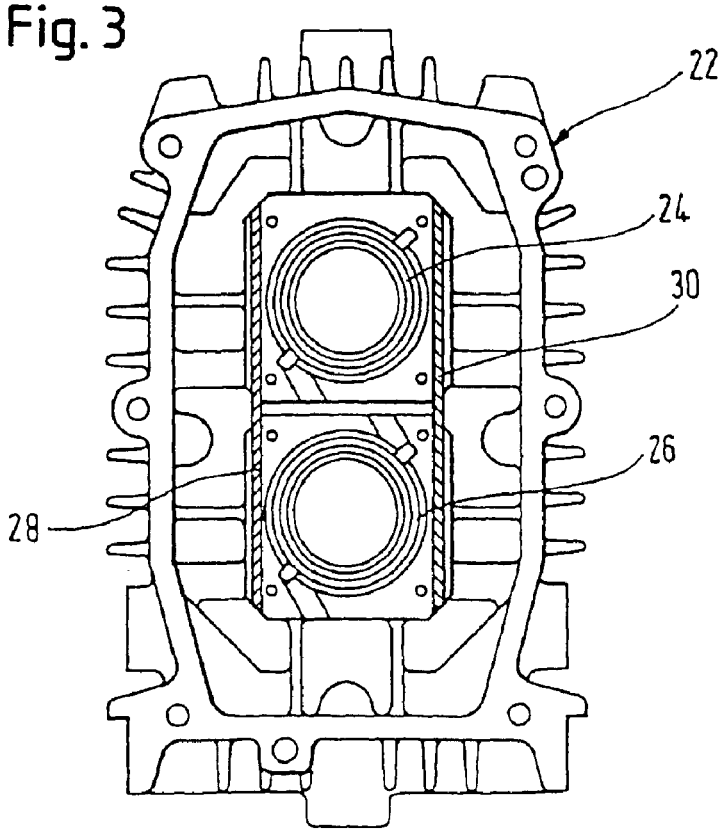
FIG. 3 shows a further variant.

In the embodiment shown in FIG. 3, the housing has a bearing cover 22, including two bearings 24, 26 for the shafts 18, 20. A stiffening rib 28, 30 made of a dispersion-strengthened aluminum alloy is cast in the bearing cover 22 on either side of the bearings 24, 26. These stiffening ribs 28, 30 on the one hand serve to stiffen the bearing of the shafts 18, 20 and on the other hand to reduce the increase in the center distance due to thermal expansion.

What is claimed is:

1. A compressor comprising a housing and at least one rotor rotatably mounted in said housing by means of a shaft, said rotor rotating without contact with said housing, said rotor consisting of a powder-metallurgical Al—Si alloy and said housing consisting essentially of aluminum, and said Al—Si alloy having a coefficient of thermal expansion which is smaller than the coefficient of thermal expansion of said aluminum of which said housing consists.

2. The compressor according to claim 1, wherein said Al—Si alloy is dispersion-strengthened.

3. The compressor according to claim 1, wherein said Al—Si alloy has the following composition:

18.5 to 21.5 wt.-% silicon, 4.6 to 5.4 wt.-% iron, 1.8 to 2.2 wt.-% nickel, balance: aluminum.

4. The compressor according to claim 1, wherein said Al—Si alloy has a coefficient of thermal expansion of approximately $16\times10^{-6}$/K.

5. The compressor according to claim 1, wherein said aluminum of which said housing consists has a coefficient of thermal expansion of approximately $23.8\times10^{-6}$/K.

6. The compressor according to claim 1, wherein said housing is cooled by an airflow.

7. The compressor according to claim 1, wherein said rotor is cooled only via the flow of media conveyed and via said shaft.

8. The compressor according to claim 1, wherein it includes two rotary pistons rolling off into each other free of contact.

9. The compressor according to claim 8, wherein it operates with internal compression.

10. The compressor according to claim 9, wherein said rotary pistons are configured to have two or three blades.

11. The compressor according to claim 1, wherein the surfaces of said rotors have an insulating layer applied thereon.

12. A compressor comprising a housing and at least one rotor rotatably mounted in said housing by means of a shaft, said rotor rotating without contact with said housing, said rotor consisting of a powder-metallurgical Al—Si alloy and said housing consisting essentially of aluminum, said Al—Si alloy having the following composition:

18.5 to 21.5 wt.-% silicon, 4.6 to 5.4 wt.-% iron, 1.8 to 2.2 wt.-% nickel, balance: aluminum.

13. The compressor according to claim 12, wherein said Al—Si alloy is dispersion-strengthened.

14. The compressor according to claim 12, wherein said Al—Si alloy has a coefficient of thermal expansion of approximately $16\times10^{-6}$/K.

15. The compressor according to claim 12, wherein said aluminum of which said housing consists has a coefficient of thermal expansion of approximately $23.8\times10^{-6}$/K.

16. A compressor comprising a housing and at least one rotor rotatably mounted in said housing by means of a shaft, said rotor rotating without contact with said housing, said rotor consisting of a powder-metallurgical Al—Si alloy and said housing consisting essentially of aluminum, and said Al—Si alloy having a coefficient of thermal expansion of approximately $16\times10^{-6}$/K.

17. A compressor comprising a housing and at least one rotor rotatably mounted in said housing by means of a shaft, said rotor rotating without contact with said housing, said rotor consisting of a powder-metallurgical Al—Si alloy and said housing consisting essentially of aluminum, and said aluminum of which said housing consists has a coefficient of thermal expansion of approximately $23.8\times10^{-6}$/K.

18. A compressor comprising a housing and at least one rotor rotatably mounted in said housing by means of a shaft, said rotor rotating without contact with said housing, said rotor consisting of a powder-metallurgical Al—Si alloy and said housing consisting essentially of aluminum, and said housing having an external body made of aluminum and a ring cast therein made of a dispersion-strengthened powder-metallurgical Al—Si alloy.

19. The compressor according to claim 18, wherein at the interface of said ring and said external body the materials thereof are fused together.

20. The compressor according to claim 18, wherein said ring directly surrounds said rotor.

21. A compressor comprising a housing and at least one rotor rotatably mounted in said housing by means of a shaft, said rotor rotating without contact with said housing, said rotor consisting of a powder-metallurgical Al—Si alloy and said housing consisting essentially of aluminum, and said housing including at least one bearing cover which is provided with stiffening ribs cast therein, made of a dispersion-strengthened powder-metallurgical Al—Si alloy.

22. The compressor according to claim 21, wherein said stiffening ribs are arranged on opposite sides of said bearings.

* * * * *